US006689958B1

(12) United States Patent
McKenney et al.

(10) Patent No.: US 6,689,958 B1
(45) Date of Patent: Feb. 10, 2004

(54) CONTROLLED IMPEDANCE EXTRUDED FLAT RIBBON CABLE

(75) Inventors: Darryl J. McKenney, Londonderry, NH (US); Steven J. Bibeau, Sandown, NH (US); Laurea J. Doiron, Jr., Pelham, NH (US)

(73) Assignee: Parlex Corporation, Methuen, MA (US)

( * ) Notice: Subject to any disclaimer, the term of this patent is extended or adjusted under 35 U.S.C. 154(b) by 0 days.

(21) Appl. No.: 10/197,713

(22) Filed: Jul. 18, 2002

(51) Int. Cl.[7] ..... H01B 7/00

(52) U.S. Cl. ..... 174/113 R; 174/117 R; 174/117 F; 174/117 FF

(58) Field of Search ..... 174/110 R, 110 AR, 174/110 SR, 110 PM, 110 FC, 113 R, 117 R, 117 F, 117 FF

(56) References Cited

U.S. PATENT DOCUMENTS

| | | | | | |
|---|---|---|---|---|---|
| 3,763,306 | A | * | 10/1973 | Marshall | 174/115 |
| 4,288,916 | A | * | 9/1981 | Verma | 29/828 |
| 4,551,576 | A | | 11/1985 | Rich | 174/36 |
| 4,573,752 | A | | 3/1986 | Rich | 339/17 F |
| 4,652,772 | A | * | 3/1987 | Shephard | 307/147 |
| 4,678,864 | A | * | 7/1987 | Cox | 174/36 |
| 4,698,457 | A | * | 10/1987 | Bordbar | 174/36 |
| 4,707,671 | A | * | 11/1987 | Suzuki et al. | 333/1 |
| 5,235,132 | A | * | 8/1993 | Ainsworth et al. | 174/36 |
| 5,446,239 | A | * | 8/1995 | Mizutani et al. | 174/36 |
| 5,554,825 | A | * | 9/1996 | Parker et al. | 174/117 F |
| 6,137,059 | A | * | 10/2000 | Quiroz | 174/113 R |

FOREIGN PATENT DOCUMENTS

| | | | | |
|---|---|---|---|---|
| EP | 0 817 313 A2 | * | 1/1998 | H01R/3/00 |
| WO | WO 96/07185 A | * | 3/1996 | H01B/7/08 |

* cited by examiner

*Primary Examiner*—William H. Mayo, III
(74) *Attorney, Agent, or Firm*—Weingarten, Schurgin, Gagnebin & Lebovici LLP

(57) ABSTRACT

A flat ribbon cable having a controlled impedance and suitable for use at high data rates. The ribbon cable includes a plurality of conductors arranged side-by-side within an insulating material. The conductors include a first portion at each end having a generally circular cross-section, a center portion of generally rectangular cross-section in which the width is greater than the height and a transition portion at each end between the first portion and the second portion. A shield is disposed over selected ones of the plurality of conductors on at least one side of the ribbon cable. A drain wire is provided that is conductively coupled to the shield and may be disposed between the shield and insulating material. The drain wire is disposed over one of the conductors and may be conductively coupled to the conductor via use of a single contact of an insulation displacement connector that engages both the drain wire and the respective conductor. Multiple shield layers and associated drain wires may be provided to provide controlled impedance for selected conductors of the ribbon cable.

15 Claims, 3 Drawing Sheets

CONTROLLED IMPEDANCE EXTRUDED FLAT RIBBON CABLE

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

The present invention relates to flat ribbon cables and more specifically to a flat ribbon cable having a controlled impedance that is suitable for applications involving high speed data transmission.

The use of flat ribbon cables throughout the electronics industry is wide spread. Such cables are often desirable because they are flexible and are generally easy to employ from the perspective of cable management. Additionally, ribbon cables may be easily terminated using insulation displacement connectors (IDC) as is known in the art. Typically, ribbon cables are formed by extruding an insulating material, such as plastic, around a plurality of conductive wires that are maintained in parallel co-planar relation.

It has been observed however, that traditional flat ribbon cables are not suitable in some high speed applications, such as those encountered with the Universal Serial Bus 2 (USB2) which can accommodate a data rate of 480 Mbps. More specifically, it has been difficult to produce a ribbon cable that is suitable for use at such high speeds using traditional fabrication techniques and structures due to the inability to accurately control the impedance of the signal carrying conductors along the length of the cable.

Accordingly, it would be desirable to have a flat ribbon cable which would present a controlled impedance along the length of the cable and would be suitable in high speed data applications, such as those encountered in USB2 applications. It would be further desirable if such a ribbon cable could be terminated using conventional insulation displacement connectors to facilitate rapid and low cost manufacture of terminated cables.

BRIEF SUMMARY OF THE INVENTION

In accordance with the present invention, a flat ribbon cable is disclosed that has a controlled impedance along the length of the cable for at least some of the conductors contained within the cable.

The disclosed flat ribbon cable includes a plurality of parallel and generally co-planar conductors. Each of the conductors has first end portions at respective ends of the flat ribbon cable. The first end portions each have a generally circular cross section. Each of the conductors has a central portion that has a generally rectangular cross section such that the width of the cross-section is greater than the height. A second portion at each end of the cable comprises a transition portion that is disposed between the respective first end portion and the central portion of the conductor.

A generally planar conductive shield layer is laminated over some or all of the conductors of the ribbon cable. The spacing between the shield layer and the respective adjacent conductors is accurately maintained to provide a controlled impedance for the conductors along the length of the cable. At least one drain wire is provided that extends along the length of the cable and is conductively coupled to the shield layer to allow the shield layer to be conductively coupled to ground or otherwise terminated at a low impedance point within an electrical circuit. In one embodiment the drain wire is generally coextensive in length with the ribbon cable conductors and is disposed directly above one of the conductors and between the shield layer and the insulating material. Since the end of the drain wire is disposed directly above one of the conductors, the respective conductor and the drain wire may be captured with a single contact of an insulation displacement connector (IDC) so as to conductively couple the respective conductor to the shield layer via the drain wire. One or more drain wires may be employed. Multiple shield layers may be provided with at least one drain wire conductively coupled to each of the shield layers. Each of the shield layers may be conductively coupled to a conductor of the cable by conductively coupling the respective drain wires to a corresponding conductor within the ribbon cable.

The presently disclosed flat ribbon cable may be produced by laminating the plurality of conductors between two insulating layers or via an extrusion process to permit high speed manufacture of cables of any desired length. Additionally, the ribbon cable may be formed by a lamination process and the shield may be encased via a secondary extrusion process.

Other features, advantages and aspects of the presently disclosed invention will be apparent from the detailed description of the invention that follows.

BRIEF DESCRIPTION OF THE SEVERAL VIEWS OF THE DRAWINGS

The invention will be more fully understood from the following detailed description of the invention taken in conjunction with the drawings of which.

DETAILED DESCRIPTION OF THE INVENTION

Figure 1:
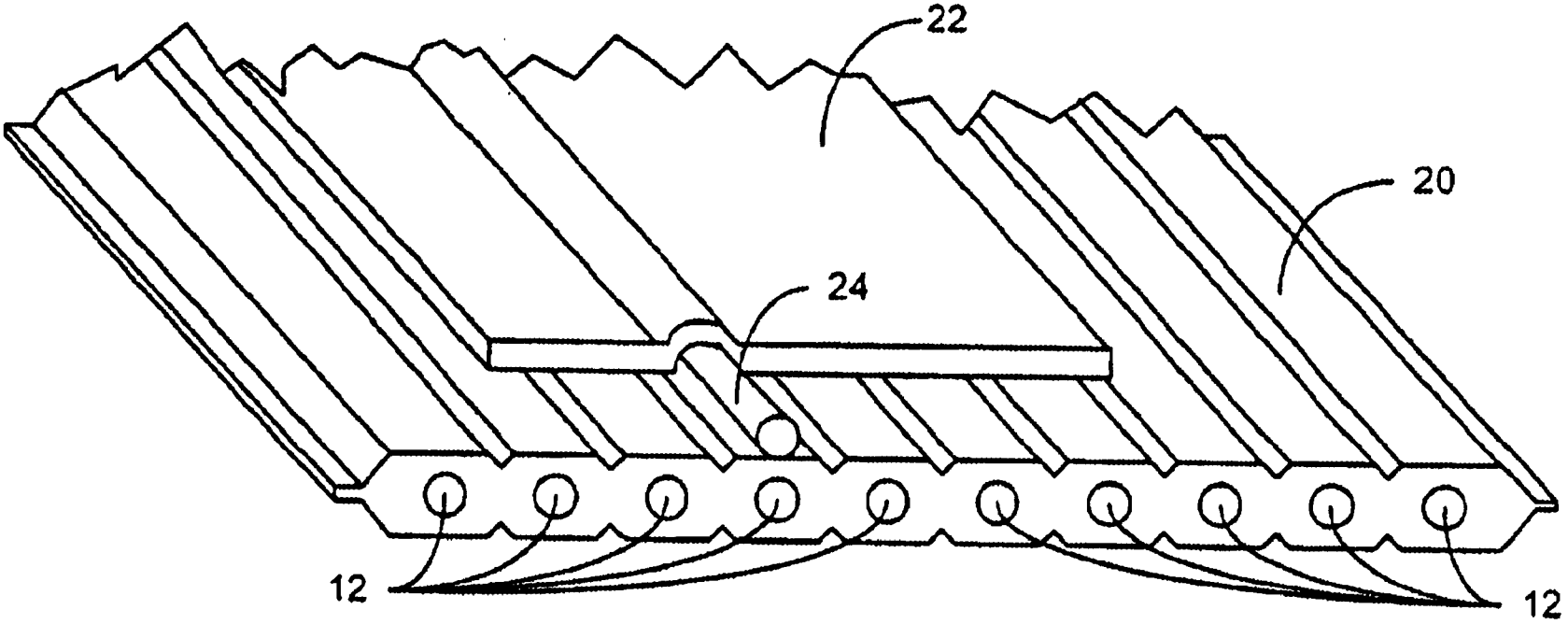
FIG. 1 is a partial perspective view of a flat ribbon cable in accordance with the present invention.
Figure 2:
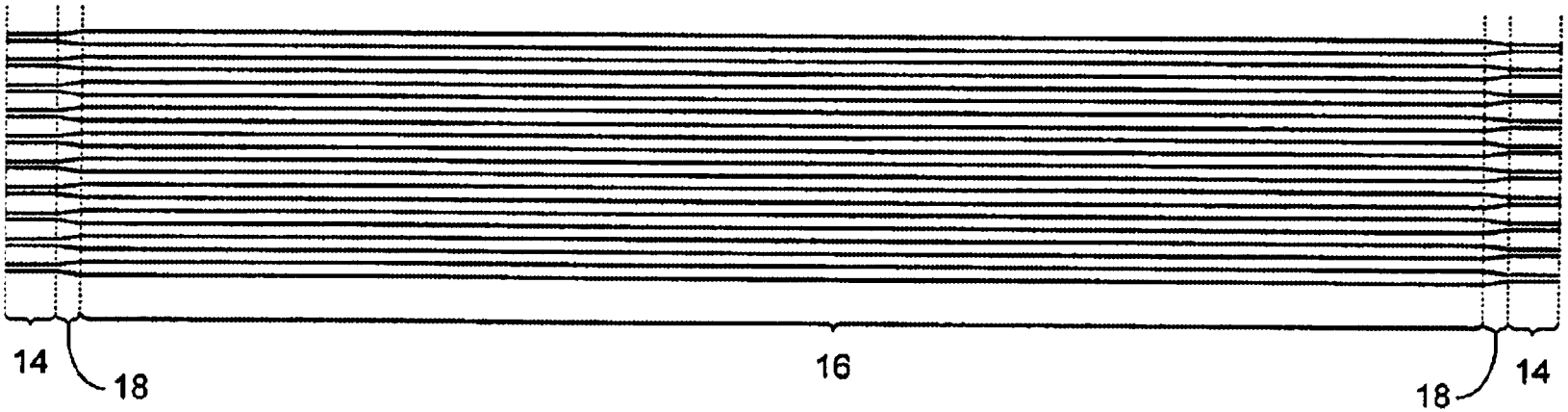
FIG. 2 is a top view of a plurality of conductors having first end portions of generally circular cross section, a central portion having a generally rectangular cross section and a transition portion between the central portion of the respective first end portions of the conductors.
Figure 3:
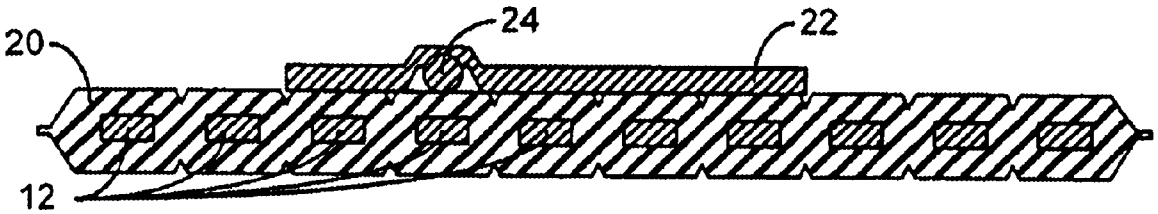
FIG. 3 is a cross sectional view of the flat ribbon cable of FIG. 1 through the central portion of the cable.

A flat ribbon cable in accordance with the present invention is depicted in FIGS. 1–3. Referring to FIG. 1, the flat ribbon cable 10 includes a plurality of parallel spaced conductors 12. The conductors 12 have a first portion 14 (FIG. 2) at each end of the respective conductor of a generally circular cross-section (FIG. 1), a center portion 16 (FIG. 2) having a generally rectangular cross-section (FIG. 3) and transition portions 18 (FIG. 2) between the center portion 16 and the respective first portions 14. The ribbon cable may be fabricated as generally disclosed in U.S. application Ser. No. 10/197,779 titled EXTRUDED FLAT CABLE which is owned by the same assignee as the present application, filed on the same date as the present application and incorporated herein by reference. It is noted, however, that the first portions 14 at the ends of the respective conductors 12 have a generally circular cross section to allow for termination of the cable using conventional insulation displacement conductors as is subsequently discussed.

More specifically, the conductors 12 are surrounded by an insulator 20 which may comprise an extruded insulation material or first and second laminated insulating layers which are applied above and below the conductors 12. A conductive shield layer or member 22 is laminated to one surface of the insulating material 20 over some or all of the conductors 12. The shield layer may comprise a conductive metallic sheet or foil, a conductive mesh, a conductive extrusion or coating or any other form of shield layer known in the art. At least one drain wire 24 is provided along the length of the cable and is conductively coupled to the shield layer 22. As depicted in FIG. 1, the shield layer 22 may be laminated over the drain wire 24 to capture the drain wire between the shield 22 and the insulating material 20. In one embodiment, the drain wire 24 is disposed above and parallel to one of the conductors 12 so that both the respective conductor 12 and the drain wire 24 may be captured by a single insulation displacement contact of an insulation displacement connector. To allow for the use of an insulation displacement connector, the shield 22 does not extend to the end of the cable 10. The shield 22 may be fabricated such that it terminates short of the end of the cable 10 or alternatively, it may be extend to the end of the cable following manufacture and be cut off short of the cable end to permit termination of the cable using an insulation displacement connector.

FIG. 3 depicts a cross section of the presently disclosed flat ribbon cable through the center portion 16 of the cable 10. As apparent from FIG. 3, the conductors 12 are flattened so as to have a generally rectangular cross section in the center portion 16 of the conductors. The flattening of the cable in the central portion 16 provides for improved cable flexibility. The width and height of the rectangular cross section, the spacing between adjacent conductors, and the spacing between the conductors and the shield layer 22 may be specified to obtain desired impedance and cross-talk characteristics.

Figure 4:
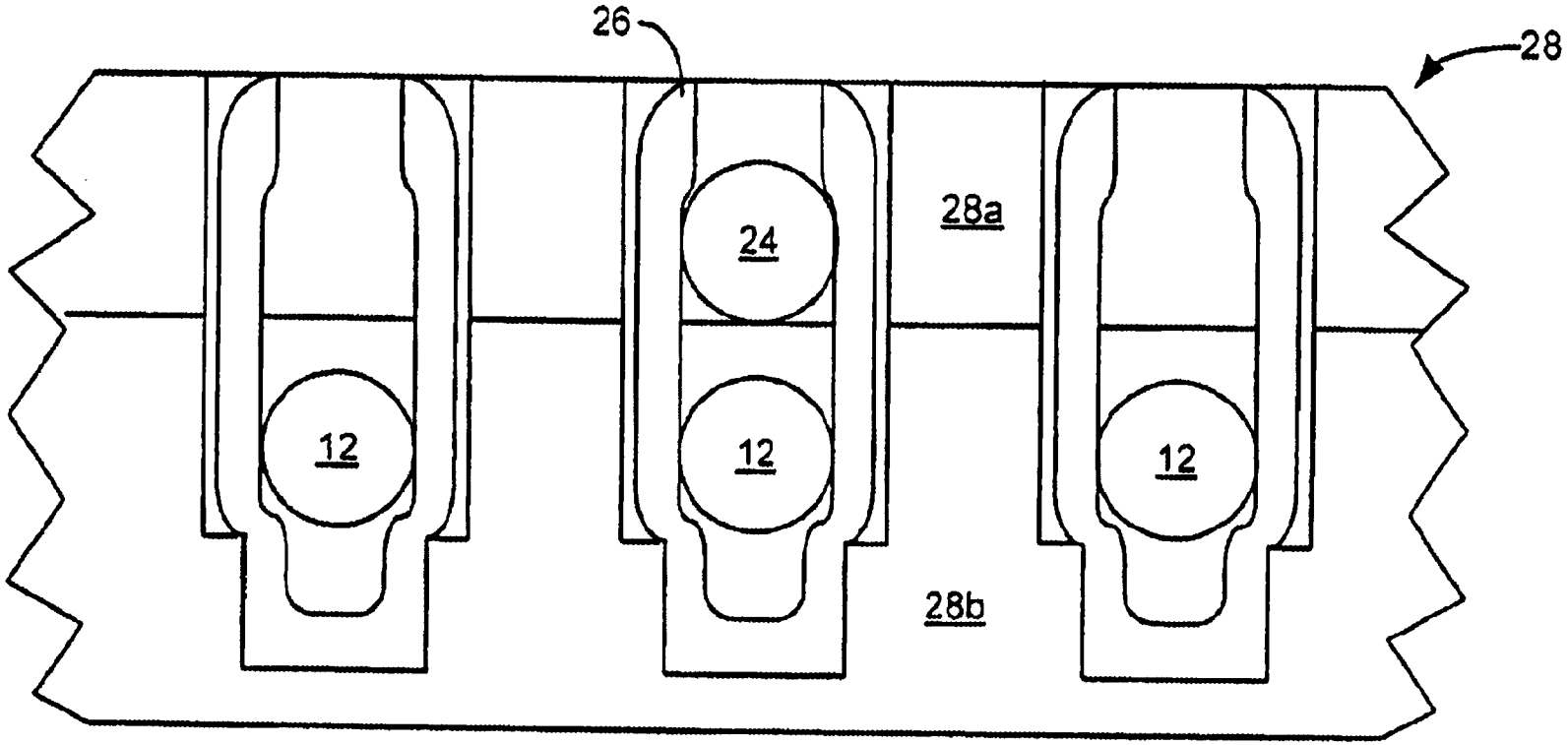
FIG. 4 is a schematic partial cross sectional view through the contacts of an insulation displacement connector depicting the capture of the drain wire and one the conductors of the ribbon cable of FIG. 1 by a single contact of the insulation displacement connector.

As depicted in FIG. 4, an IDC contact 26 within a conventional IDC connector 28 having first and second connector portions 28*a* and 28*b* engages both the conductor 12 of the ribbon cable 10 and the adjacent drain wire 24 so as to conductively couple the shield layer 22 to the respective conductor 12. While a single drain wire 24 is employed in the illustrated embodiment, it will be appreciated that any desired number of drain wires 24 may be employed and the location of the drain wires may be selected for specific applications. For example, to minimize cross-talk between signal carrying conductors, a drain wire 24 may be provided over every other conductor 12 so that a ground conductor is provided between signal carrying conductors. Upon termination of the cable 10 with an insulation displacement connector signal carrying conductors 12 having corresponding drain wires 24 are all conductively coupled to the shield layer 22.

The drain wire 24 may have a circular cross section along the length of the wire or alternatively, the drain wire 24 may have a cross section similar to the cross section of the plurality of the signal carrying conductors 12 within the ribbon cable 10. This alternative drain wire configuration provides greater flexibility for the ribbon cable. Additionally, the drain wire 24 may be located between the shield layer 22 and the plurality of conductors as illustrated or alternatively, the shield layer 22 may be located between the drain wire 24 and the plurality of conductors 12.

The shield layer 22 may extend over all conductors 12 within the cable 10 or only selected conductors 12 within the cable 10.

While the above-described embodiment depicts a shield layer 22 laminated to a single side of the flat ribbon cable 10, it will be appreciated that a shield layer 22 may alternatively be laminated to both sides of the flat ribbon cable and drain wires coupled to respective shield layers 22 may be captured along with a corresponding conductor 12 by an insulation displacement contact 26 (FIG. 4). The insulation displacement contact 26 may capture a single conductor and one drain wire or alternatively, a single conductor and two drain wires if coupling a single conductor 12 to drain wires 24 on opposing sides of the ribbon cable 10.

Furthermore, while the above-described shield layer is shown as being laminated to the ribbon cable insulating material 20, the shield layer(s) may be extruded within an insulating casing either during the same extrusion process employed to form the ribbon cable or alternatively as a co-extrusion following the formation of the ribbon cable via either a lamination or an extrusion process.

Additionally, while the Drawing depicts a single shield layer coupled to a conductor via a single drain wire, multiple shield layers may be provided with at least one drain wire conductively coupled to each of the shield layers. Each of the shield layers may be conductively coupled to one or more conductors of the cable by conductively coupling drain wires that conductively coupled to the respective shield layer to corresponding conductors within the ribbon cable. This connection may be made as described above, via the use of an IDC connector. In this manner, a controlled impedance may be obtained for conductors proximate to the respective shield layer.

It will be apparent to those of ordinary skill in the art that modifications to and variations of the above described controlled impedance flat ribbon cable may be made without departing from the inventive concepts disclosed herein. Accordingly, the invention should not be viewed as limited except by the scope and spirit of the appended claims.

What is claimed is:

1. A ribbon cable having a length and a width, said ribbon cable comprising:

a plurality of parallel spaced conductors located in a first plane, each of said plurality of conductors having conductor end portions at opposing ends and a central conductor portion between said conductor end portions, said conductor end portions having a generally circular cross section;

an insulating material surrounding said plurality of conductors, said insulating material having opposing surfaces generally parallel to said first plane;

a drain wire located generally in a second plane spaced from said first plane by a predetermined distance, said drain wire having respective drain wire ends in a third plane that passes through one of said plurality of conductors, said third plane being orthogonal to said first plane; and a conductive shield layer laminated to one of said opposing surfaces of said insulating material, said conductive shield layer located in a fourth plane that is generally parallel with said first plane and spaced therefrom by a predetermined distance, said shield layer having a width selected such that the shield layer confronts selected ones, but not all of said plurality of conductors, said shield layer being conductively coupled to said drain wire.

2. The ribbon cable of claim 1 wherein the central conductor portion of each of said plurality of parallel spaced conductors has a generally rectangular cross-section.

3. The ribbon cable of claim 2 wherein said conductors each include transition portions at respective ends of the conductor, said transition portions being located between said end portions and said central conductor portion.

4. The ribbon cable of claim 1 wherein said drain wire is substantially parallel to said one of said plurality of conductors along the length of the drain wire.

5. The ribbon cable of claim 1 wherein said second plane and said fourth plane generally comprise the same plane.

6. The ribbon cable of claim 1 wherein said drain wire has a generally circular cross-section along the length of the drain wire.

7. The ribbon cable of claim 1 wherein said insulating material comprises first and second insulating layers that are laminated to said plurality of conductors to maintain said conductors in parallel spaced relation.

8. The ribbon cable of claim 7 wherein said first and second insulating layers comprise first and second plastic layers.

9. The ribbon cable of claim 1 wherein said insulating material comprises an integral extruded insulating material.

10. The ribbon cable of claim 1 wherein said insulating material comprises a plastic material.

11. The ribbon cable of claim 1 further including at least one insulation displacement connector having at least one conductive insulation displacement contact, said at least one insulation displacement connector mounted to one end of said ribbon cable such that said at least one insulation displacement contact conductively engages a predetermined one of said plurality of parallel spaced conductors and said drain wire.

12. A ribbon cable having a length and a width, said ribbon cable comprising:

a plurality of parallel spaced conductors located in a first plane, said conductors each having conductor end portions at opposing ends of the respective parallel spaced conductors and a central conductor portion between said conductor end portions, said conductor end portions having a generally circular cross section;

an insulating material surrounding said plurality of conductors;

at least two drain wires located generally in a second plane spaced from said first plane by a predetermined distance, said at least two drain wires having respective ends disposed above selected ones of said plurality of conductors and in respective planes generally orthogonal to said first plane; and at least two conductive shield layers that are electrically isolated from one another, said at least two conductive shield layers located in a fourth plane that is generally parallel to said first plane and spaced therefrom by a predetermined distance, said at least two shield layers each having a width selected such that each shield layer confronts different selected ones of said plurality of conductors, each of said at least two shield layers being conductively coupled to at least one of said at least two drain wires.

13. The ribbon cable of claim 12 wherein the central conductor portion of each one of said plurality of parallel spaced conductors has a generally rectangular cross-section.

14. The ribbon cable of claim 12 further including at least one insulation displacement connector having at least two conductive insulation displacement contacts conductively coupling said at least two drain wires to corresponding conductors of said ribbon cable to conductively couple the respective shield layers to the conductors corresponding to said at least two drain wires.

15. A ribbon cable having a length and a width, said ribbon cable comprising:

a plurality of parallel spaced conductors located in a first plane, each of said plurality of conductors having conductor end portions at opposing ends and a central conductor portion between said conductor end portions, said central conductor portion of each of said plurality of parallel spaced conductors having a generally rectangular cross-section, said conductor end portions having a generally circular cross section;

an insulating material surrounding said plurality of conductors, said insulating material having opposing surfaces generally parallel to said first plane;

a drain wire located generally in a second plane spaced from said first plane by a predetermined distance, said drain wire having respective drain wire ends in a third plane that passes through one of said plurality of conductors, said third plane being orthogonal to said first plane; and a conductive shield layer laminated to one of said opposing surfaces of said insulating material, said conductive shield layer located in a fourth plane that is generally parallel with said first plane and spaced therefrom by a predetermined distance, said shield layer having a width selected such that the shield layer confronts selected ones, but not all of said plurality of conductors, said shield layer being conductively coupled to said drain wire.

* * * * *

UNITED STATES PATENT AND TRADEMARK OFFICE

CERTIFICATE OF CORRECTION

PATENT NO. : 6,689,958 B1
DATED : February 10, 2004
INVENTOR(S) : Darryl J. McKenney et al.

It is certified that error appears in the above-identified patent and that said Letters Patent is hereby corrected as shown below:

Title page,
Insert Item:

-- [65] Prior Publication Data

US-2004-0011552-A1 Jan. 22, 2004 --

Signed and Sealed this

Ninth Day of November, 2004

JON W. DUDAS
*Director of the United States Patent and Trademark Office*